US006256941B1

(12) United States Patent
Yu et al.

(10) Patent No.: US 6,256,941 B1
(45) Date of Patent: Jul. 10, 2001

(54) PAD FOR PANEL

(75) Inventors: Shawn Yu; Harv Pastunink, both of Hudsonville; Steven Heyer, Jenison, all of MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/326,191

(22) Filed: Jun. 4, 1999

(51) Int. Cl.[7] ..... E04B 1/84

(52) U.S. Cl. ..... 52/144; 52/239; 52/481.2; 52/489.1; 52/489.2; 52/781.3; 52/789.1; 52/797.1; 52/800.11; 181/284; 181/294

(58) Field of Search ..... 52/144, 145, 239, 52/481.2, 483.1, 489.1, 489.2, 781.3, 789.1, 797.1, 800.1, 800.11, 801.1; 181/284, 287, 290, 291, 294

(56) References Cited

U.S. PATENT DOCUMENTS

| | | | | |
|---|---|---|---|---|
| 2,262,426 | * | 11/1941 | Hall | 52/511 |
| 2,264,961 | * | 12/1941 | Ward | 52/483.1 X |
| 3,103,410 | | 9/1963 | Dobbins . | |
| 3,848,043 | | 11/1974 | Garrick et al. . | |
| 4,067,678 | | 1/1978 | Beranek, Jr. et al. . | |
| 4,146,999 | * | 4/1979 | Petrovec et al. | 52/145 |
| 4,248,325 | * | 2/1981 | Georgopoulos | 181/284 |
| 4,362,773 | | 12/1982 | Shikinami . | |
| 4,423,573 | | 1/1984 | Omholt et al. . | |
| 4,428,454 | | 1/1984 | Capaul et al. . | |
| 4,474,840 | | 10/1984 | Adams . | |
| 4,627,199 | | 12/1986 | Capaul . | |
| 4,682,457 | | 7/1987 | Spencer . | |
| 4,832,152 | | 5/1989 | Schuelke et al. . | |
| 5,111,579 | | 5/1992 | Andersen . | |
| 5,135,073 | * | 8/1992 | Nelson | 181/290 |
| 5,144,777 | * | 9/1992 | Fishel et al. | 52/144 |
| 5,213,885 | | 5/1993 | Zogg et al. . | |
| 5,298,694 | | 3/1994 | Thompson et al. . | |
| 5,423,151 | | 6/1995 | Caro et al. . | |
| 5,624,518 | | 4/1997 | Stief et al. . | |
| 5,639,441 | | 6/1997 | Wilkins et al. . | |
| 5,723,831 | | 3/1998 | Martin et al. . | |
| 5,778,612 | * | 7/1998 | Kissinger et al. | 52/239 X |
| 5,899,035 | * | 5/1999 | Waalkes et al. | 52/239 |

FOREIGN PATENT DOCUMENTS

| | | | | |
|---|---|---|---|---|
| 485117 | * | 5/1992 | (EP) | 52/144 |
| WO 98/28503 | | 7/1998 | (WO) . | |

* cited by examiner

*Primary Examiner*—Laura A. Callo
(74) *Attorney, Agent, or Firm*—Flynn, Thiel, Boutell & Tanis, P.C.

(57) ABSTRACT

A space-dividing wall panel system includes an improved acoustic and tackable cover pad. The cover pad includes an interior molded panel which is compressed about its peripheral edges wherein the compressed edge sections provide the required rigidity for the cover pad. While edge rails are provided in these edge sections, the edge rails are not rigidly connected to each other but instead are adhered to the molded panel. The edge rails are provided for mounting the cover pad to a wall panel frame and provide rigid edge areas to which a cover fabric is adhered. The molded panel is formed of a fiberglass having layers of a scrim material embedded therein for tackability. The molded panel further includes a compressed mounting region which has an increased rigidity to facilitate mounting of receptacle bezels thereto.

23 Claims, 6 Drawing Sheets

PAD FOR PANEL

FIELD OF THE INVENTION

The invention relates to a cover pad or tile for a space-dividing wall panel and, more particularly, to a removable acoustic cover pad which is tackable.

BACKGROUND OF THE INVENTION

Open office areas typically are subdivided into smaller work areas by space-dividing wall panel arrangements. Such wall panel arrangements typically include panel sections, which are serially connected together into various two-way, three-way and four-way connections to define individual workstations. Thereafter, additional system components are suspended from the wall panels, such as worksurfaces, cabinets and the like.

Some wall panel arrangements are formed with an open rectangular frame which is covered by vertically enlarged cover pads or tiles. Typically, the open interior areas are provided to permit communication and/or power cabling to be routed therethrough. Once the wall panel arrangement is installed, the cover pads are then removably connected on the panel frames to cover the panel interiors.

Numerous constructions have been utilized for such cover pads. Often, the cover pad is formed from a rigid rectangular frame and an additional panel such as a fiberglass panel is mounted to the frame. An aesthetically pleasing fabric is then laid over the front face of the panel and secured to the cover pad frame. Many of these pads are acoustical in that they are made of an acoustic dampening material, and are tackable to permit push pins to be pushed therein.

Typically, the frame is constructed of separate rails which are rigidly secured together. However, such rigid rectangular frames require additional manufacturing steps such as welding.

It therefore is an object of the invention to overcome a number of the disadvantages associated with known cover pads.

The invention relates to an improved cover pad for a space-dividing wall panel system. The cover pad is an acoustical type cover pad which dampens sound and also is tackable to receive push pins or tacks therein. The cover pad has an improved construction wherein an interior molded panel is provided which is compressed about its peripheral edges to define compressed edge sections which provide rigidity to the cover pad. While peripheral edge rails are joined to the periphery of the molded panel, the compressed edge sections are sufficiently rigid such that the outer edge rails are not rigidly connected one to the other. Rather, the edge rails are bonded to the edge sections of the molded pad by suitable adhesives which simplifies the panel construction and reduces costs.

Further, the molded panel is formed from a laminate-like material having multiple layers of fiberglass and an embedded scrim material. The fiberglass layers have a lower density in the central region of the molded panel located inwardly of the compressed edge sections to provide an increased acoustical dampening function for the cover pad. Further, the scrim material provides layers or seams of a tackable material which facilitates the receipt of push pins and the like.

Still further, the molded panel includes a mounting region which is compressed similar to the edge sections disposed adjacent thereto. The mounting region has a greater rigidity and defines an area through which ports or apertures are provided to receive communication or electrical receptacles therethrough. The increased rigidity of this mounting region facilitates mounting of bezels or other trim components within the receptacle ports.

Other objects and purposes of the invention, and variations thereof, will be apparent upon reading the following specification and inspecting the accompanying drawings.

Figure 1:
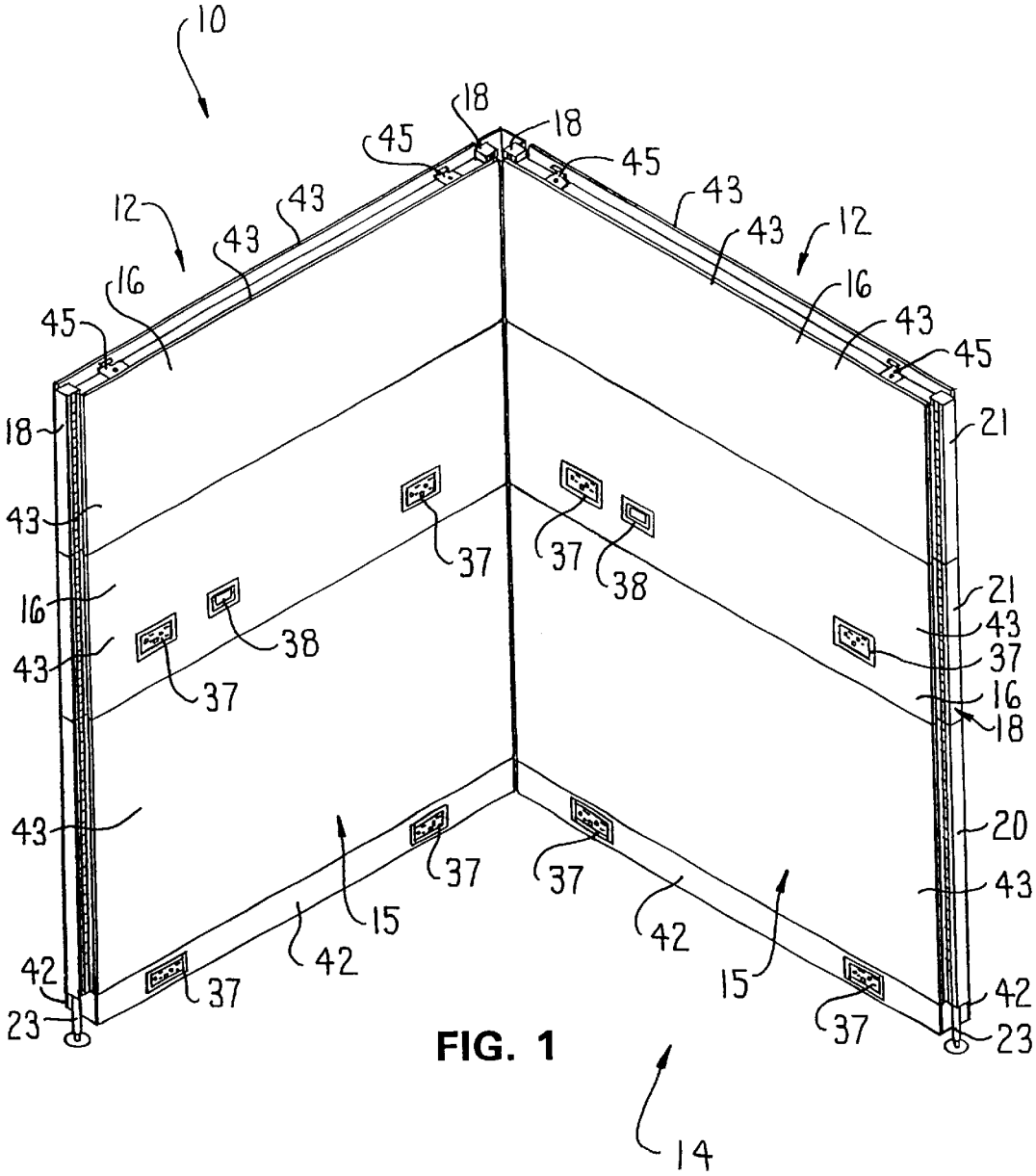
FIG. 1 is a perspective view of a wall panel arrangement having a plurality of wall panels serially connected together.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the invention and designated parts thereof. Said terminology will include the words specifically mentioned, derivatives thereof, and words of similar import.

DETAILED DESCRIPTION

Figure 2:
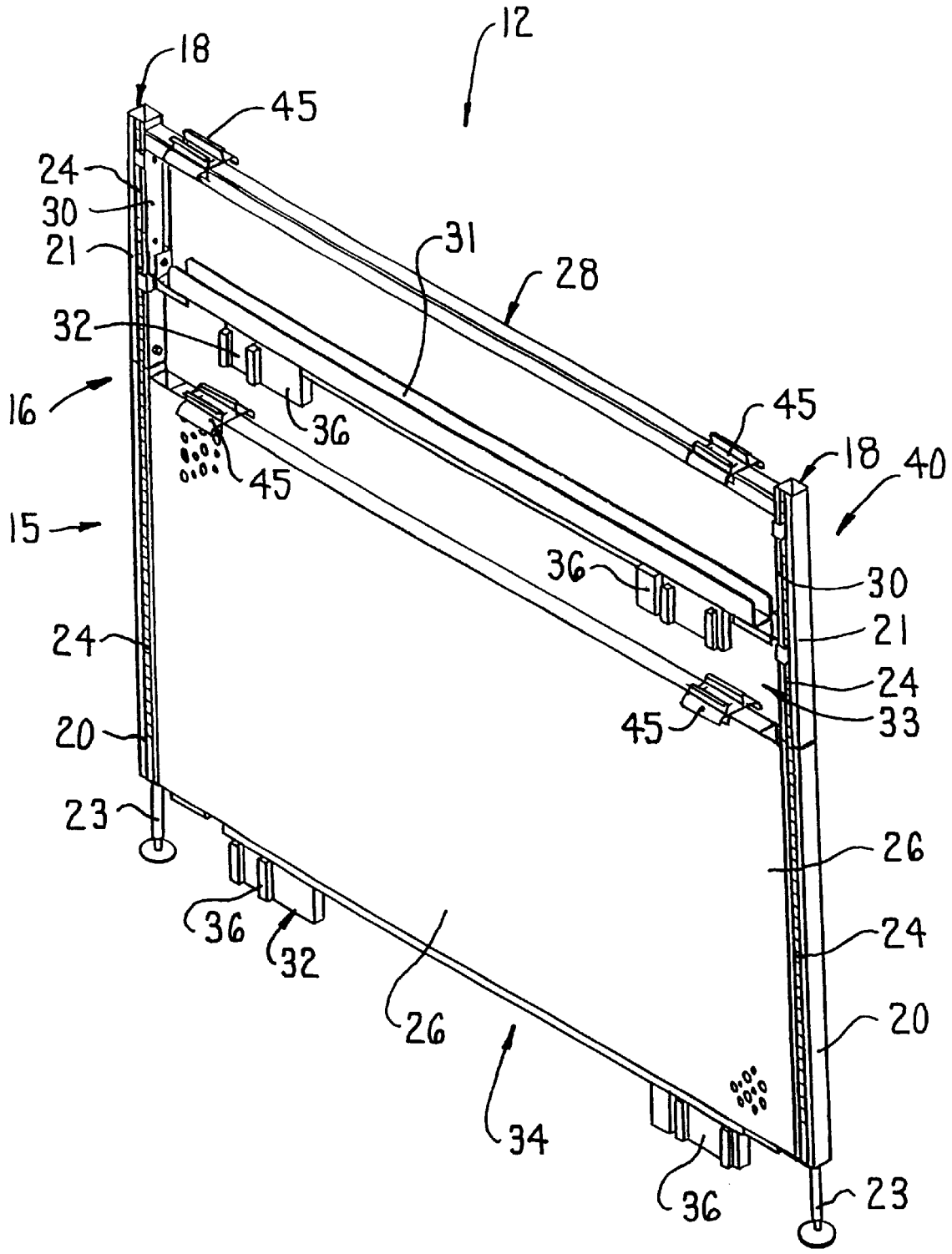
FIG. 2 is a perspective view of an interior frame of one of the wall panels wherein outer cover pads are removed.

Referring to FIGS. 1 and 2, the invention relates to an improved cover pad construction for a wall panel system 10 wherein the cover pad construction is an acoustical and tackable type.

The wall panel system 10 includes a selected number of upstanding wall panel assemblies 12 serially connected, for example, in two-panel straight or angled, or three- or four-panel corner configurations to subdivide an office area into separate workstations 14. In FIG. 1, two wall panel assemblies 12 are serially connected together in end-to-end relation to define a corner.

Generally, each workstation 14 is defined by a selected arrangement of base panel assemblies 15 which are serially connected one with the other to at least form a lower section of an upstanding wall. Besides selectively subdividing the office area by the placement of the base panel assemblies 15, the wall panel system 10 also permits modular adjustment of the wall height by selected placement of one or more extension panel assemblies 16 vertically on each base panel assembly 15. In the illustrated arrangement, one extension panel assembly 16 is vertically positioned or "stacked" on the base panel assembly 15 although additional extension panel assemblies 16 are mountable one atop the other to extend the overall height of the wall panel assembly 12.

A more detailed disclosure as to structure and function of the illustrated wall panel system 10 is provided in U.S. Pat.

No. 5,806,258, the disclosure of which is incorporated herein in its entirety. The following description of the wall panel system 10 therefore is more generally directed to the overall components of the system 10.

More particularly, each wall panel assembly 12 extends laterally and is supported at its opposite ends by two spaced apart upright posts 18. The wall panel system 10 is a post-type system having a plurality of the wall panel assemblies 12 serially connected together wherein a serially adjacent pair of wall panel assemblies 12 share a common intermediate post 18 in a 2-panel straight connection.

In a multi-panel corner connection such as that illustrated in FIG. 1, the serially adjacent wall panel assemblies 12 are connected together by a corner connection arrangement substantially the same as that disclosed in a U.S. patent application (Attorney Ref: Haworth Case 287) entitled CONNECTOR ARRANGEMENT FOR ADJACENT PANELS which is being filed concurrently herewith and is owned by the assignee hereof. The disclosure of this application is incorporated herein in its entirety.

The wall panel assembly 12 at least includes the base panel assembly 15 and may also include a selected number of the extension panel assemblies 16. In view thereof, each post 18 at least includes a lower post section 20, which is a in load-bearing contact with the floor, and optionally includes one or more extension post sections 21, which removably connect to and extend vertically from said lower post section 20. Each lower post section 20 is vertically elongate and has a support glide 23 on the lower end thereof.

Figure 3:
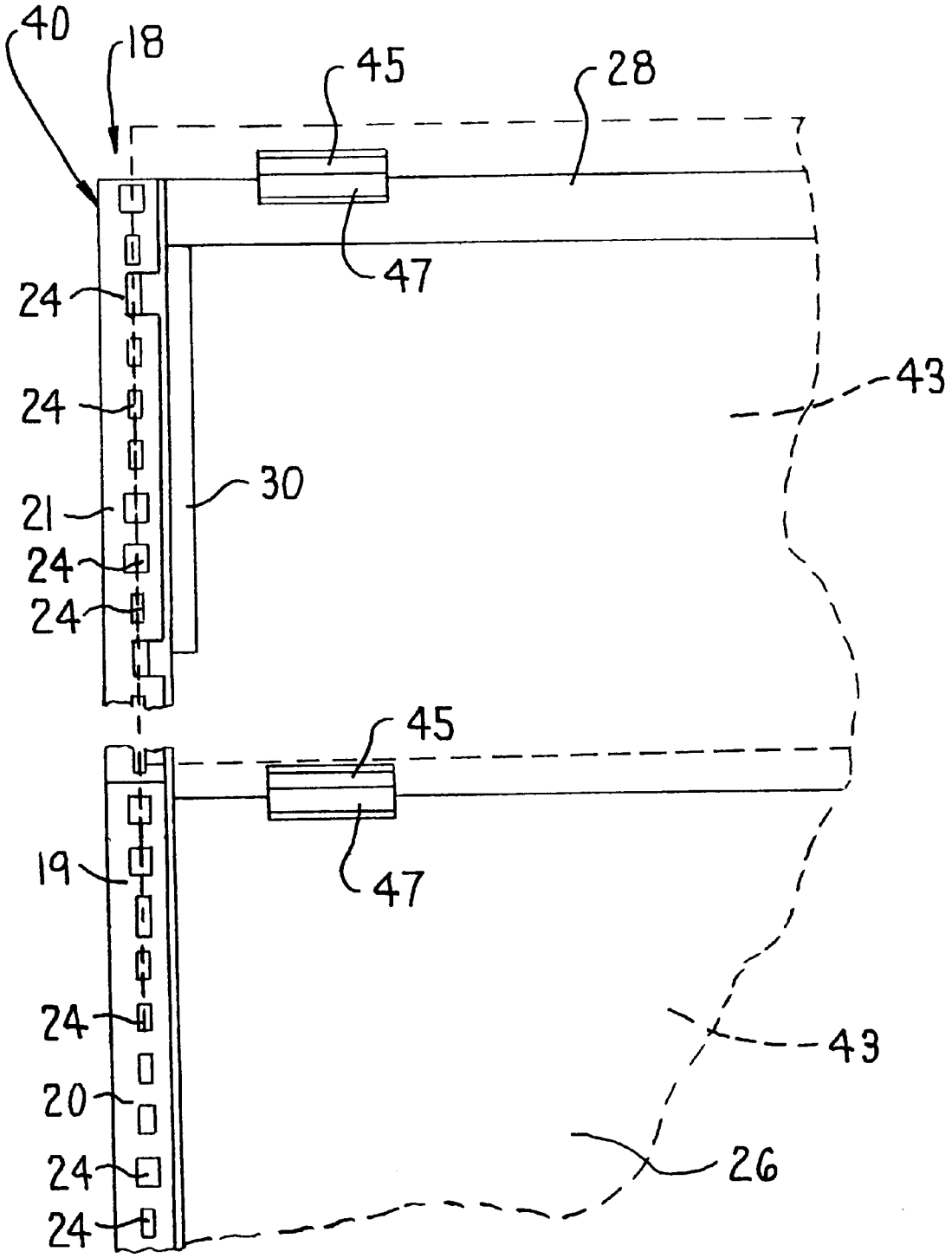
FIG. 3 is a partial front elevational view of the interior frame having cover pads illustrated in phantom outline.
Figure 4:
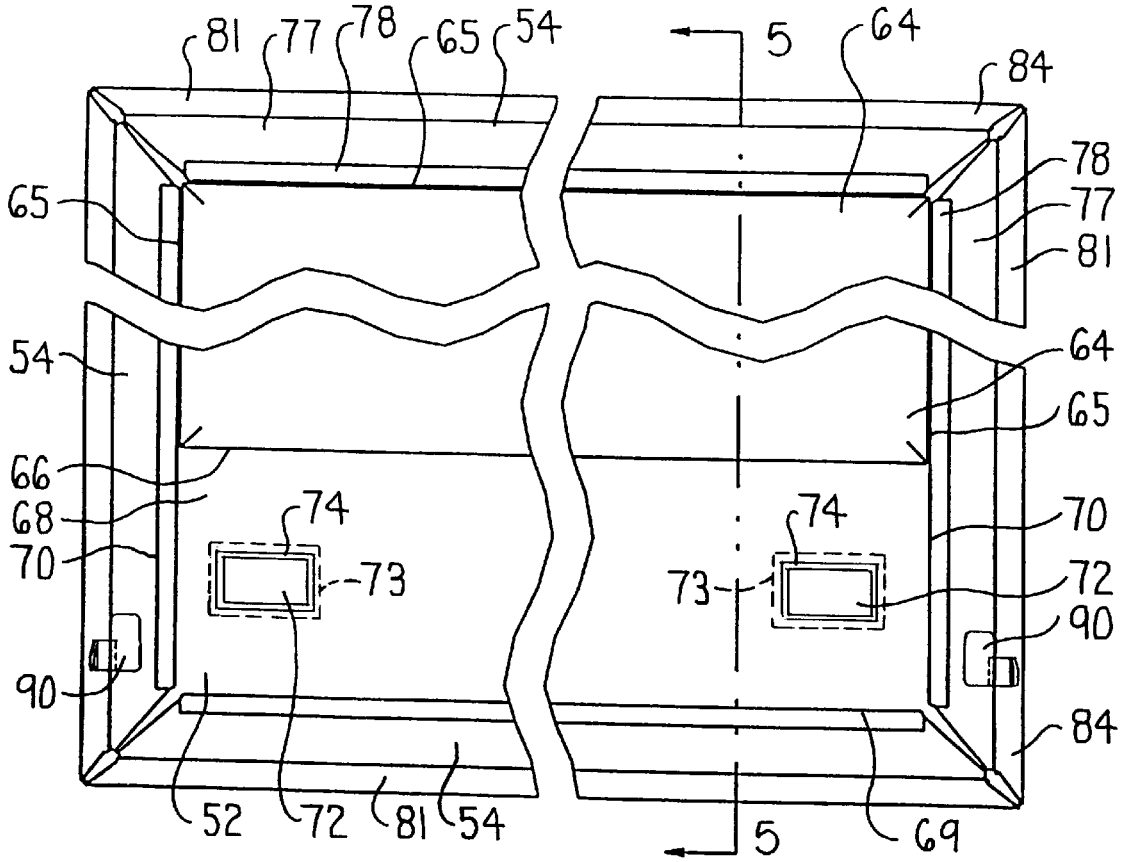
FIG. 4 is a broken rear view of a cover pad.
Figure 5:
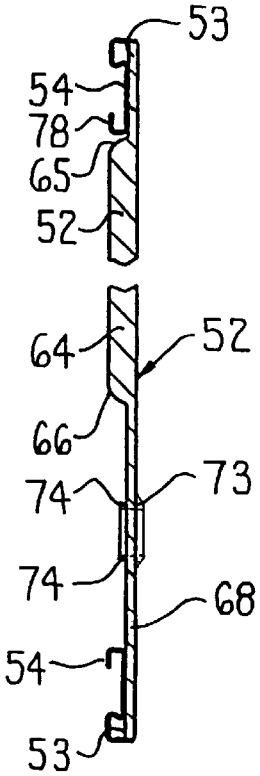
FIG. 5 is a side view in cross-section of the cover pad as taken along line 5—5 of FIG. 4.
Figure 6:
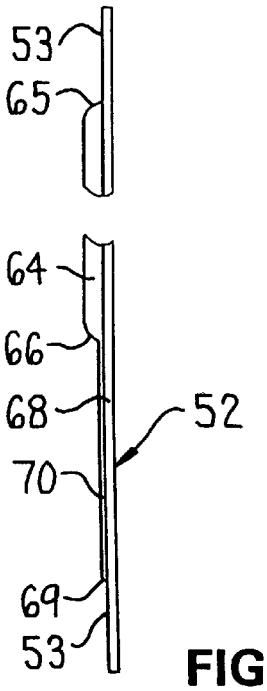
FIG. 6 is a side view of a molded panel for the cover pad.

To permit the connection of furniture components to the post 18 on opposite outward facing sides 19 thereof, the lower post section 20 and each extension post section 21 includes a plurality of rectangular apertures 24 (FIGS. 2 and 3) which are formed on opposite outward facing sides of the support post 23 and in particular, are vertically spaced along the longitudinal length thereof. The apertures 24 accommodate hook-like projections (not illustrated) of furniture component support brackets which said brackets are conventional.

The wall panel assemblies 12 further include a rectangular base panel 26 which is vertically enlarged and is connected at its opposite ends to the lower post sections 20. The wall panel assembly 12 also includes at least one crossbar 28 which extends laterally between the upper ends of the extension post sections 21. The crossbar 28 is connected to the extension post sections 21 by mounting brackets 30 which are disclosed in further detail in co-pending U.S. Patent Application (Attorney Ref: Haworth Case 295) entitled FRAME ARRANGEMENT FOR A WALL PANEL SYSTEM which is being filed concurrently herewith and is owned by the assignee hereof. The disclosure of this application is incorporated herein in its entirety.

The crossbar 28 also includes a cable trough 31 connected thereto. The cable trough 31 extends horizontally between the posts 18 and opens upwardly to store communication and/or power cabling therein.

Conventional power distribution assemblies 32 (PDA's) are suspended from the lower edges of the cable trough 31 as well as the base panel 26 to define beltline and base raceways 33 and 34 respectively. Each PDA 32 includes a receptacle unit or power block 36 at each opposite end thereof to which is mounted a power receptacle 37. Each receptacle 37 includes conventional three-prong electrical outlets which face forwardly from the wall panel assemblies 12. Additionally, communication receptacles also may be supported on the upper edge of the base panel 26 so as to be accessible from a front side of the wall panel assemblies 12 as seen in FIG. 1.

The uprights 18, crossbar 28 and base panel 26 thereby define an interior panel frame 40 which has open areas in which power and/or communication cabling is stored. To hide this cabling, the base raceway 34 is enclosed by a horizontally elongate raceway cover 42 wherein a raceway cover 42 encloses each opposite side of the base raceway 34. Each raceway cover 42 includes suitable receptacle ports through which the power receptacles 37 are accessed.

The remainder of the panel frame 40 is enclosed by a plurality of cover pads 43 which are vertically enlarged and overlie the panel frame 40. These cover pads 43 have a finished appearance to define aesthetically-pleasing outward facing side surfaces of the wall panel assemblies 12. To support the pads 43 on the panel frame 40, each of the crossbar 28 and the upper edge of the base panel 26 includes a laterally spaced apart pair of connector brackets 45.

Figure 7:
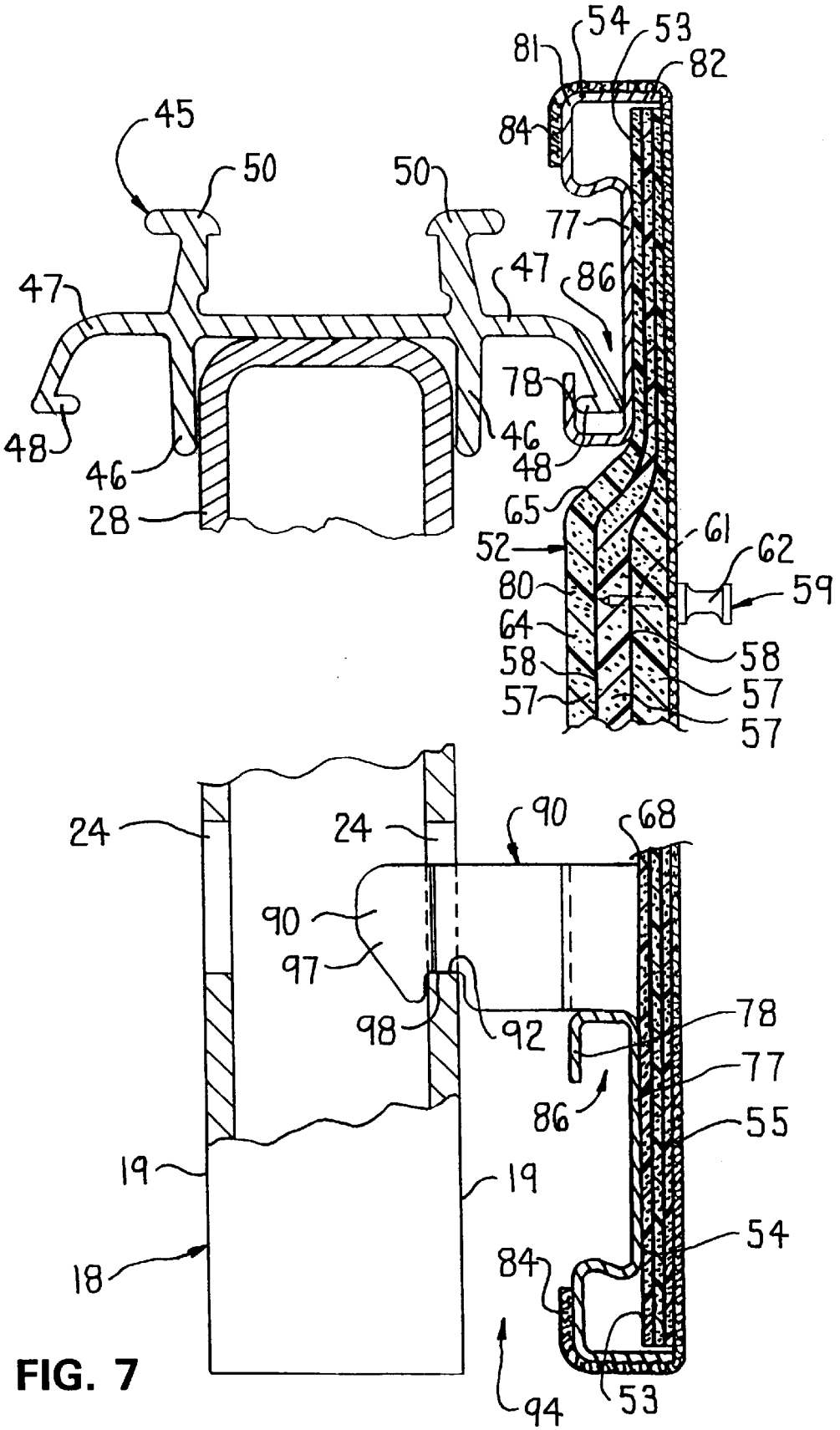
FIG. 7 is a side elevational view in cross-section of the wall panel as taken along line 7—7 of FIG. 1 wherein one cover pad is removed therefrom.

Referring to FIG. 7, each of the brackets 45 includes downwardly depending legs 46 which are sidewardly spaced apart and fit over the opposite sides of the crossbar 28. The connector bracket 45 further includes cantilevered connector flanges 47 which project outwardly and curve downwardly and include an inwardly projecting lip 48 thereon. The connector flanges 47 are adapted to be connected to an upper edge of a respective cover pad 43 as will be described herein in further detail, and are provided on the opposite sides of the connector bracket 45 to permit mounting of a cover pad 43 on each opposite face of the panel frame 40.

Each connector bracket 45 also includes upstanding flanges 50. The upstanding flanges 50 are used on a wall panel assembly 12 having a large lateral width wherein the flanges 50 support an additional bracket which cooperates with a lower edge of the cover pad 43 to support the cover pad 43 sidewardly.

Referring more particularly to the cover pads 43 of the invention, each cover pad 43 is formed of a generally rigid molded panel 52 which includes compressed edge sections 53 wherein the compression of the edge sections 53 provides significant rigidity to the molded panel 52. The cover pad 43 also includes metal rails 54 which are adhered to the compressed edge sections 53 but unlike conventional cover pads, the rails 54 are not rigidly connected to each other, for example, to define a rigid rectangular frame. In conventional panels, such a rigid rectangular frame imparts rigidity to the overall pad structure. However, the cover pad 43 of the invention provides rigidity through the compressed edge sections 53 while the rails 54 primarily permit hanging of the cover pad 43 on the panel frame 40 and also serve as mounting areas for securing to a cover fabric 55 thereto.

Referring to FIGS. 4–7, the molded panel 52 is formed as a laminate having multiple layers 57 of an acoustic material and additional intermediate layers 58 of a tackable scrim material. The layers 57 define acoustic layers and preferably are formed of a non-woven fiberglass. The scrim layers 58 are formed of a material which is more suited to retaining push pins 59 such as a non-woven polyester. The fiberglass material facilitates the dampening of sound while the scrim material 58 can be pierced by and provides support to the push pin 159 (FIG. 7). In particular, the scrim material 58 is more readily adapted to hold the pointed pin shaft 61 which projects inwardly from a pin head 62 although the fiberglass material, after being molded, also is tackable and has some ability to hold a push pin 59.

In the unmolded condition, the multiple layers of fiberglass material 57 and scrim material 58 define a laminate of stock material which has a significant thickness. The stock material is provided generally with the shape of the rectangular molded panel 52 and thereafter, is compressed significantly to define the molded panel 52.

The molded panel 52 is formed with the compressed edge sections 53 which extend about the outer periphery thereof. The compressed edge sections 53 preferably have a thickness of approximately 0.125 inches and a density of 24 pounds per cubic foot. This thickness and density imparts significant rigidity to the molded panel 52 such that a separate rigid rectangular frame is not required.

To improve the acoustic properties of the molded panel 52, however, the molded panel 52 also includes a central acoustic section 64 which is compressed during molding but to a lesser degree then the compressed edge sections 53. The central section 64 preferably is rectangular and has outer edges 65 on the top and sides thereof which define a stepped boundary between the central section 64 and the compressed edge sections 53. A lower edge 66 of the central section 64, however, is spaced vertically from the lowermost edge section 53 as will be described in further detail herein.

The central acoustic section 64 is expanded relative to the compressed edge sections 53 and preferably has a thickness of 0.375 inches and a density of eight pounds per cubic foot. The thickness of the acoustic section 64 preferably should be at least several times larger than the thickness of the compressed edge sections 53.

The molded panel 52 also includes a mounting section 68 which extends vertically between the central acoustic section 64 and the lower edge section 53. The upper edge of the mounting section 68 is defined by the edge 66 of the central section 64, and the mounting section 68 further includes a lower edge 69 which defines the boundary between the mounting section 68 and the adjacent compressed edge section 53. The mounting section 68 also includes side edges 70 which define a boundary between the adjacent vertical edge sections 53.

Preferably, the mounting section 68 has a slightly greater thickness then the compressed edge section 53 wherein the thickness thereof is approximately 0.188 inches, which thickness is greater than the edge sections 53 but less than the central acoustic section 64. As such, the edges 69 and 70 of the mounting section 68 are raised relative to the adjacent edge sections 53 although the mounting section 68 is still compressed significantly almost to the extent of the molded edge sections 53. As a result, the mounting section 68 is more rigid than the central acoustic section 64 and effectively defines an interior area to which trim components may be attached.

More particularly, the mounting section 68 can be provided with rectangular receptacle ports 72 which open horizontally therethrough and are adapted to be aligned with and provide access to the electrical receptacles 37 (FIG. 1). The mounting section 68 includes trim components mounted thereto and in this particular instance, includes an outward facing rectangular bezel 73 which covers the periphery of the receptacle port 72. A bezel 73 is attached to the mounting section 68 by a mounting flange 74 which projects through the receptacle port 72 and engages or grips the edges of the ports 72. Since the mounting section 68 of the molded panel 52 is compressed to a significant extent, the mounting section 68 is relatively rigid, and the bezel 73 and mounting flange 74 grip the edges of the mounting section 68 without additional reinforcement or connectors being required.

The cover pad 43 further includes a plurality of the edge rails 54 which are adapted to be secured to the compressed edge sections 53 of the molded panel 52. More particularly, a pair of horizontal rails 54 is provided so as to extend along the upper and lower edge sections 53 and a pair of shorter vertical rails 54 are secured to the vertical edge sections 53. Each of the rails 54 is secured to the back surface of the molded panel 52 by a suitable adhesive such as a hot melt adhesive.

The rails 54 thereby extend about the periphery of the molded panel 52. However, since the compressed edge sections 53 provide significant rigidity to the molded panel 52, connections between adjacent ends of the rails 54 at the corners of the cover pad 43 are not required. In particular, the rails 54 while secured to the molded panel 52 are themselves separate from each adjacent rail 54. Thus, it is not necessary to construct a rigid rectangular frame which thereby minimizes the complexity and construction of the cover panel 43.

Figure 8:
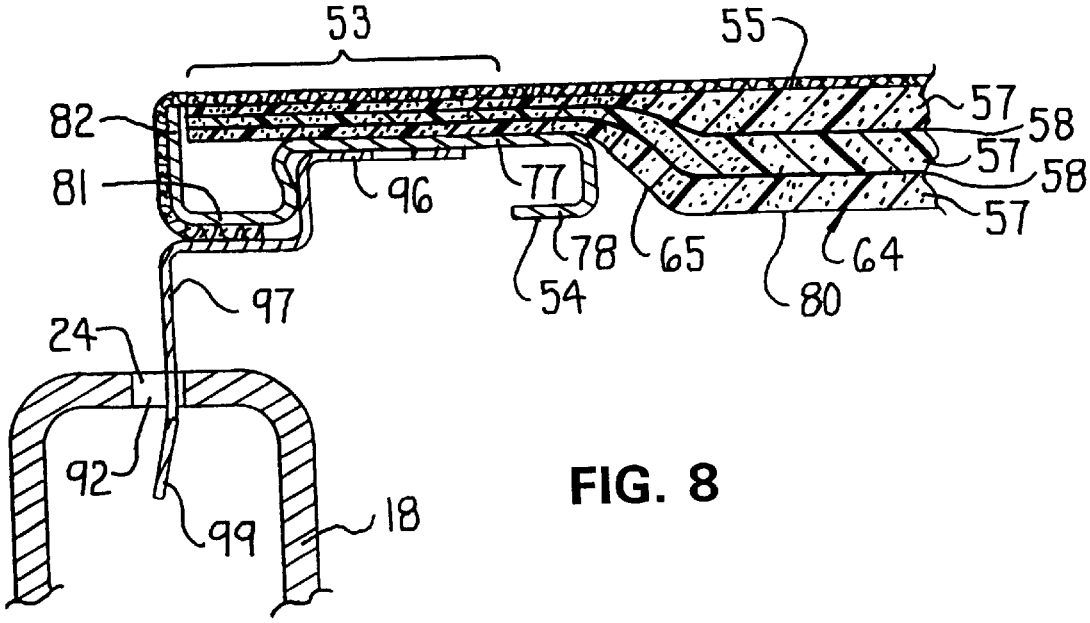
FIG. 8 is a partial plan view in cross-section of the wall panel as taken along the line 8—8 of FIG. 7.

Each rail 54 is elongate and is mitered at its opposite ends. Referring to FIGS. 7 and 8, each rail 54 has a front wall 77 which faces forwardly and abuts against a rear face of an adjacent edge section 53. The front wall 77 and edge section 53 are joined together by the aforementioned adhesive. The front wall 77 is integrally formed with a rearwardly projecting mounting flange 78 which provides rigidity to the rail 54 and projects rearwardly so as to be disposed proximate a rear face 80 of the acoustic section 64.

An outer edge of the front wall 77 is bent rearwardly and sidewardly to define a rear wall 81 wherein the rear wall 81 defines a rearward facing surface to which the cover fabric 55 may be glued as discussed herein. A further outer flange 82 projects forwardly from the rear wall 81 to define the outer periphery of the cover pad 43 and provide a rigid protective plate adjacent to the outermost edge of the molded panel 52. The outer flange 82 thereby provides a rigid periphery for the cover pad 43 and serves to prevent damage to the edge sections 53 disposed adjacent thereto.

The cover pad 43 also includes the fabric cover material 55. The fabric 55 overlies the front face of the molded panel 52 and, near the periphery thereof, extends rearwardly around the outer flange 82 of the rail 54. The outermost edge 84 of the fabric 55 is then wrapped inwardly against the rear wall 81 of the rail 54 wherein the rails 54 define mounting surfaces extending about the periphery of the cover pad 43. The outer fabric edge 84 is connected to the rail 54 preferably by a hot melt adhesive.

The arrangement of rails 54 further defines mounting means for mounting the individual cover pads 43 to the panel frame 40. More particularly, the inner flange 78 defines a mounting channel 86 wherein the channel 86 on the top horizontal rail 54 opens upwardly as generally illustrated in FIG. 7. This upward opening channel 86 is adapted to receive the lip 48 of the connector flange 47 therein. When the connector flange 47 and the inner rail flange 78 are slidably fitted together as illustrated in FIG. 7, the upper edge of the cover pad 43 is prevented from moving horizontally away from the panel frame 40.

To provide vertical support to the cover pad 43, the bottom end of each side rail 54 includes a connector bracket 90 which projects rearwardly from the pad 43 and inserts into a corresponding one of the post apertures 24. During assembly, the upper rail flange 78 is moved upwardly until the connector flange 47 is fully seated within the mounting channel 86 wherein the hook-like connector brackets 90 can be swung into the corresponding apertures 24.

Thereafter, the cover pad 43 is shifted downwardly until the connector bracket 90 is hooked onto the lower edge 92 of the aperture 24. While the lip 48 on the connector flange 47 is now separated from the bottom of the mounting channel 86, the lip 48 is still confined horizontally within the mounting channel 86 such that the top edge of the cover pad 43 is prevented from moving horizontally toward or away from the frame 40. The pad 43 is spaced outwardly of the panel frame 40 to define a cable management space 94.

Figure 9:
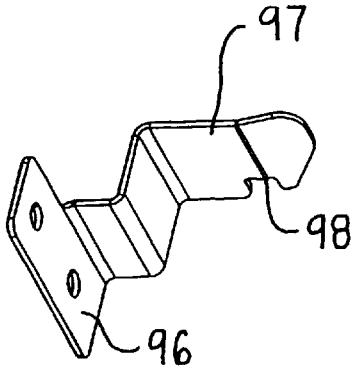
FIG. 9 is a perspective view of a connector bracket on the cover pad.

Referring to FIGS. 7–9, the connector bracket 90 is a bent metal clip having a base plate 96 which lies against and is secured to the rear face of the front rail wall 77 as seen in FIG. 8. The connector bracket 90 extends rearwardly and then sidewardly to extend around the outer flange 82 and fabric 55. The connector bracket 90 also includes a rearwardly projecting hook 97 which defines a downward opening slot 98. The slot 98 is adapted to slide downwardly onto and hook over the lower aperture edge 92 as illustrated in FIG. 7.

The end of the hook 97 includes an angled section 99 which is angled outwardly to facilitate alignment with the post aperture 24. When fully engaged, the hook 97 lies close to the side edge of the aperture 24 to limit sideward shifting of the cover pad 43.

With the above-described arrangement, the pad 43 is constructed from a sheet of stock material having a significant thickness wherein the stock material is formed of layers of the fiberglass acoustic material and a tackable scrim material. The stock material is compressed to define the compressed edge sections 53, the central acoustic section 64 and the mounting section 68. The compressed edge sections 53 provide significant rigidity to the molded panel 52. Accordingly, separate independent rails 54 need only be provided wherein the rails 54 are adhered to the edge sections 53 respectively.

During assembly, the raised edges of the acoustic section 64 and the mounting section 68 also serve as locators for the rails 54 so that the rails 54 can be readily aligned with the corresponding edge sections 53. Once the rails 54 are adhered to the molded panel 52, the assembly is covered by a suitable cover material such as fabric 55. The fabric 55 is laid over the front face of the molded panel 52 and then wrapped around the outer edges thereof wherein the fabric edges are adhered to the outer mounting flange 82 on the rail 54. Thus, the rails 54 provide rigid linear edges to which the fabric 55 is connected.

The rails 54 also include the connector brackets 90 proximate the lower corners of the cover pad 43. To install the cover pad 43, the upper edge thereof is slid upwardly until the mounting channel 86 engages the corresponding lip on the connector bracket 45. The lower edge of the cover panel 43 is then swung downwardly and rearwardly until the hooks 97 are inserted into respective apertures 24 on the post 18. The pad 43 is then shifted downwardly to allow the hooks 97 to engage the lower aperture edges 92 wherein the connector bracket 45 is still captivated horizontally within the mounting channel 86.

The above-described cover pad arrangement is less complex and is easier to construct while providing desirable acoustic and tackability properties. The cover pad 43 also can be readily mounted to a wall panel frame 40. While the pad 43 is rectangular, other geometric shapes may be provided having linear or curved edges.

Although a particular embodiment of the invention have been disclosed in detail for illustrative purposes, it will be recognized that variations or modifications of the disclosed apparatus, including the rearrangement of parts, lie within the scope of the present invention.

What is claimed is:

1. A cover pad for a wall panel comprising:

a molded panel defined by a fiberglass material, said molded panel including elongate compressed edge sections extending longitudinally about a periphery of said molded panel, said compressed edge sections being rigid to provide rigidity to said molded panel, said molded panel further including an enlarged central acoustic section disposed inwardly of said compressed edge sections having a density which is less than a density of said compressed edge sections and having a thickness which is greater than said compressed edge sections;

a plurality of elongate edge rails which extend longitudinally along said compressed edge sections, said edge rails being secured to each of said compressed edge sections about the periphery of said molded panel wherein said rails are separate from each other; and flexible fabric overlying a front side of said molded panel and extending outwardly and wrapping around the periphery defined by said compressed edge sections, edges of said flexible fabric overlying portions of said rails and being fixedly secured to said edge rails.

2. A cover pad according to claim 1, wherein said edge rails are secured to said compressed edge sections by an adhesive, each of said edge rails being free of rigid connections with each adjacent one of said edge rails.

3. A cover pad according to claim 2, wherein said central acoustic section has a thickness which is approximately three times as large as a thickness of said edge sections.

4. A cover pad according to claim 3, wherein said central acoustic section has a density of 8 pounds per cubic foot and said edge sections have a density of 24 pounds per cubic foot.

5. A cover pad according to claim 1, wherein said frame rails include mounting means for mounting said cover pad to a wall panel frame.

6. A cover pad according to claim 1, wherein said molded panel comprises a plurality of layers of fiberglass for acoustics and at least one layer of scrim material for tackability.

7. A cover pad for a wall panel comprising:

a molded panel defined by a fiberglass material, said molded panel including elongate compressed edge sections extending longitudinally about a periphery of said molded panel, said compressed edge sections being rigid to provide rigidity to said molded panel, said molded panel further including an enlarged central acoustic section disposed inwardly of said compressed edge sections and having a density less than a density of said compressed edge sections and a thickness which is greater than said compressed edge sections, and said molded panel including a compressed mounting section defined between said acoustic section and said edge sections, said mounting section being relatively rigid and being exposed inwardly of said compressed edge sections;

a plurality of elongate rails which extend longitudinally along said compressed edge sections; and flexible fabric overlying a front side of said molded panel and extending outwardly and wrapping around the periphery defined by said compressed edge sections.

8. A cover pad according to claim 7, wherein said mounting section includes receptacle ports formed there through, a trim arrangement being connected to said mounting region within said receptacle ports.

9. A cover pad according to claim 7, wherein said edge raids are separate from each other.

10. A cover pad according to claim 9, wherein said edge rails are secured individually to said compressed edge sections by an adhesive.

11. A cover pad according to claim 9, wherein said compressed edge sections of said molded panel comprise four said compressed edge sections forming said molded panel as a rectangular shaped molded panel, each of said edge sections receiving one of said elongate edge rails.

12. A cover pad according to claim 7, wherein said edge rails do not extend over the front side of said molded panel.

13. A cover pad for a wall panel comprising:

a molded panel defined by a fiberglass material, said molded panel including elongate compressed edge sections extending longitudinally about a periphery of said molded panel, said compressed edge sections being rigid to provide rigidity to said molded panel, said molded panel further including an enlarged central acoustic section disposed inwardly of said compressed edge sections and having a density less than a density of said compressed edge sections and a thickness which is greater than a thickness of said compressed edge sections;

a plurality of elongate edge rails which extend longitudinally along said compressed edge sections to further rigidify said compressed edge sections, each of said edge rails being free of rigid connections with each adjacent one of said edge rails such that said edge rails are secured to said compressed edge sections separate from each other and extend substantially about the periphery of said molded panel; and flexible fabric overlying a front side of said molded panel and wrapping around the periphery defined by said compressed edge sections, edges of said flexible fabric overlying portions of said edge rails.

14. A cover pad according to claim 13, wherein said edge rails are secured to each of said compressed edge sections at a rear side of said molded panel.

15. A cover pad according to claim 13, wherein said edge rails are secured to said compressed edge sections by an adhesive.

16. A cover pad according to claim 13, wherein said edge rails do not extend over the front side of said molded panel.

17. A cover pad according to claim 13, including a compressed mounting section defined between said acoustic section and said compressed edge sections, said compressed mounting section being relatively rigid and being disposed inwardly of said compressed edge sections.

18. A cover pad according to claim 13, wherein said molded panel has a geometric shape defined by a plurality of said compressed edge sections, wherein each of said plurality of said edge rails each has a longitudinal length corresponding to a length of a corresponding one of said compressed edge sections to which said edge rail is secured.

19. A cover pad for a wall panel comprising:

a molded panel defined by a fiberglass material, said molded panel having a geometric shape defined by a plurality of elongate compressed edge sections which extend longitudinally about a periphery of said molded panel, said compressed edge sections being rigid to provide rigidity to said molded panel, said molded panel further including an enlarged central acoustic section disposed inwardly of said compressed edge sections having a density which is less than a density of said compressed edge sections and having a thickness which is greater than said compressed edge sections;

a plurality of elongate edge rails which extend longitudinally along said compressed edge sections, each of said edge rails being secured to corresponding lengths of said compressed edge sections of said molded panel wherein said rails are separate from each other and having a longitudinal length corresponding to a length of said edge section corresponding thereto; and flexible fabric overlying a front side of said molded panel and wrapping around the periphery defined by said compressed edge sections, edges of said flexible fabric overlying portions of said edge rails and being fixedly secured to said edge rails.

20. A cover pad according to claim 19, wherein said edge rails are secured to said compressed edge regions by an adhesive, each of said edge rails being free of rigid connections with each adjacent one of said edge rails.

21. A cover pad according to claim 19, wherein a compressed mounting section is defined between said acoustic section and said edge sections, said mounting section being relatively rigid and being exposed in a central area inwardly of said compressed edge regions.

22. A cover pad according to claim 19, wherein said frame rails include mounting clips for mounting said cover pad to a wall panel frame.

23. A cover pad according to claim 19, wherein said molded panel comprises a plurality of layers of fiberglass for acoustics and at least one layer of scrim material for tackability.

* * * * *